US008206138B2

(12) United States Patent
Komai et al.

(10) Patent No.: US 8,206,138 B2
(45) Date of Patent: Jun. 26, 2012

(54) SCROLL FLUID MACHINE WITH BALL COUPLING ROTATION PREVENTION MECHANISM

(75) Inventors: Yuji Komai, Tokyo (JP); Kazutaka Suefuji, Kawasaki (JP); Koji Fukui, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 874 days.

(21) Appl. No.: 12/285,037

(22) Filed: Sep. 29, 2008

(65) Prior Publication Data

US 2009/0087331 A1 Apr. 2, 2009

(30) Foreign Application Priority Data

Sep. 28, 2007 (JP) ..... 2007-256752

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |

(52) U.S. Cl. ..... 418/55.3; 418/55.1; 384/609

(58) Field of Classification Search ..... 418/55.3, 418/55.1; 384/609

See application file for complete search history.

(56) References Cited

U.S. PATENT DOCUMENTS

| | | | | |
|---|---|---|---|---|
| 4,259,043 | A * | 3/1981 | Hidden et al. | 418/55.3 |
| 5,167,494 | A * | 12/1992 | Inagaki et al. | 418/55.3 |
| 5,911,566 | A * | 6/1999 | Terauchi et al. | 418/55.3 |
| 2009/0110580 | A1 * | 4/2009 | Suefuji et al. | 418/55.3 |

FOREIGN PATENT DOCUMENTS

| | | | |
|---|---|---|---|
| JP | 2-34781 | U | 3/1990 |
| JP | 2000-74050 | A | 3/2000 |
| JP | 2000074050 | A * | 3/2000 |
| JP | 2001-82356 | A | 3/2001 |

OTHER PUBLICATIONS

Japanese Office Action including English language translation dated Feb. 28, 2012 (Six (6) pages).

* cited by examiner

*Primary Examiner* — Mary A Davis
(74) *Attorney, Agent, or Firm* — Crowell & Moring LLP

(57) ABSTRACT

This invention provides a scroll type fluid machine which can simultaneously realize the stabilization of the behavior in the rotational direction of an orbiting scroll and the reduction in the manufacturing cost by the ease of holding a grease. In the scroll type fluid machine, three pairs of rotation prevention mechanisms are provided between a casing and an orbiting scroll. The rotation prevention mechanism is constituted of first and second ball coupling mechanisms having a function different from each other. The first ball coupling mechanism supports the thrust load of the orbiting scroll. Meanwhile, the second ball coupling mechanism supports the rotation force of the orbiting scroll.

21 Claims, 8 Drawing Sheets

SCROLL FLUID MACHINE WITH BALL COUPLING ROTATION PREVENTION MECHANISM

BACKGROUND OF THE INVENTION

1. Field of the Invention

The present invention relates to a scroll type fluid machine which is suitably used as an air compressor, a vacuum pump, or the like.

2. Description of the Related Art

In general, there has been known a scroll type compressor as a scroll type fluid machine in which an orbiting scroll is driven in an orbiting manner relative to a fixed scroll by means of a drive source such as an electric motor, whereby a fluid such as air is continuously compressed in a compression chamber provided between the both scrolls (for example, Japanese Patent Application Laid-Open Nos. 2000-74050 and 2001-82356).

Such a conventional scroll type compressor is constituted of a fixed scroll, an orbiting scroll opposed to the fixed scroll, and a rotation prevention mechanism. The fixed scroll is fixed to a casing and has a spiral wrap portion provided upright on an end plate. The orbiting scroll is provided in the casing in an orbiting manner and has a wrap portion provided upright on the end plate and overlapping with the wrap portion of the fixed scroll to define plural compression chambers. The rotation prevention mechanism is provided between the rear surface side of the orbiting scroll and the casing so as to prevent the rotation of the orbiting scroll.

In the prior art, an annular ball transfer race as the rotation prevention mechanism is provided so as to be opposed to the outer peripheral side of the orbiting scroll and the casing, and plural balls interpose between respective ball transfer races. According to this constitution, in the prior art, a thrust load acting on the orbiting scroll can be dispersed onto many balls, whereby a larger thrust load is supportable.

In the above prior art, a circular through-hole is provided in the ball transfer race, and the wall surface of the through-hole is curved, whereby the support of the thrust load on the orbiting scroll and the rotation prevention are simultaneously performed. However, when this constitution is applied to a large scroll type fluid machine with large inertia moment of the orbiting scroll, a force in a radial direction for stopping rotation force is insufficient, whereby the behavior in the rotational direction of the orbiting scroll becomes unstable.

In addition, in the prior art, the wall surface of the through-hole is curved, whereby the support of the thrust load on the orbiting scroll and the prevention of the rotation are simultaneously performed, and therefore, the curvature of the wall surface is required to be managed with high accuracy. In this respect, the prior art has such a configuration that, for instance, the ball transfer race is formed such as to surround an orbit bearing, and a large number of balls are arranged over the whole circumference of the ball transfer race. Therefore, the number of balls becomes extremely large, which causes increase in dispersion of dimension of the ball transfer race and that of the through-hole. As a result, the dimension management is difficult, whereby the manufacturing cost and the management cost tend to be increased.

Further, in the prior art, the rotation prevention mechanism includes balls and the ball transfer race arranged between the rear surface side of the orbiting scroll and the casing over the whole circumference. Here, the orbit bearing for rotatably supporting the orbiting scroll and a drive shaft is disposed on the inner peripheral side of the rotation prevention mechanism. In an oilless scroll type fluid machine, in order to supply a lubricant to each ball of the rotation prevention mechanism, the entire rotation prevention mechanism arranged in an annular manner is required to be sealed, and therefore, it becomes difficult to hold the lubricant.

The present invention has been made in view of the above problems, and it is an object of the present invention to provide a scroll type fluid machine which can realize the stabilization of the behavior in the rotational direction of an orbiting scroll, and, at the same time, the reduction in the manufacturing cost by the ease of the holding of a grease.

SUMMARY OF THE INVENTION

In order to solve the above problems, the present invention is applied to a scroll type fluid machine including a casing, a fixed scroll provided in the casing, an orbiting scroll, and a rotation prevention mechanism provided between the casing and the orbiting scroll. The fixed scroll has a spiral wrap portion provided upright on an end plate. The orbiting scroll has a wrap portion provided upright on the end plate and orbits in such a state that the wrap portion is overlapped with a wrap portion of the fixed scroll, whereby compresses or expands a fluid in a fluid chamber between these wrap portions. The rotation prevention mechanism prevents the rotation of the orbiting scroll.

As a constitution adopted in the present invention, the rotation prevention mechanism comprises a pair of load supporting members provided so that ball support surfaces are opposed to each other between the orbiting scroll and the casing side, a first ball coupling mechanism including a load supporting ball provided between the pair of load supporting members and supporting a load in a thrust direction, and a second ball coupling mechanism including a pair of rotation prevention supporting members provided so that ball support surfaces are opposed to each other between the orbiting scroll and the casing and a rotation prevention ball provided between the pair of rotation prevention supporting members and preventing the rotation of the orbiting scroll.

Further, the rotation prevention mechanism comprises a pair of load supporting members provided so that ball support surfaces are opposed to each other between the orbiting scroll and the casing side, a first ball coupling mechanism including a load supporting ball provided between the pair of load supporting members and supporting a load in a thrust direction, and a second ball coupling mechanism including a pair of rotation prevention supporting members provided so that ball support surfaces are opposed to each other between the orbiting scroll and the casing side and a rotation prevention ball provided between the pair of rotation prevention supporting members and preventing the rotation of the orbiting scroll. At least the three rotation prevention mechanisms each pair being constituted of the first and second ball coupling mechanisms are disposed at an interval in the peripheral direction so as to be located on the outer peripheral side of the orbiting scroll.

Further, the rotation prevention mechanism comprises a first ball coupling mechanism constituted of a pair of load supporting members provided so that ball support surfaces are opposed to each other between the orbiting scroll and the casing side, a load supporting ball provided between the pair of load supporting members and supporting a load in a thrust direction, and an annular groove provided in a ball support surface of the pair of load supporting members and having an arc-shaped cross section making a rolling-contact with the both end sides in the thrust direction of the load supporting ball, and a second ball coupling mechanism constituted of a pair of rotation prevention supporting members provided so that ball support surfaces are opposed to each other between the orbiting scroll and the casing side, a rotation prevention ball provided between the pair of rotation prevention supporting members and preventing the rotation of the orbiting scroll, and a circular groove provided in the ball support surface of the pair of rotation prevention supporting members and having a peripheral wall with a linear cross section making a rolling-contact with the both end sides in a direction inclined from the thrust direction of the rotation prevention ball.

Further, when the load in the thrust direction acts on the orbiting scroll, the first ball coupling mechanism may receive a larger load than the second ball coupling mechanism.

Further, when the rotation force acts on the orbiting scroll, the second ball coupling mechanism may receive a larger rotation force than the first ball coupling mechanism.

Further, the both end sides in the thrust direction of the load supporting ball of the first ball coupling mechanism may make a rolling-contact with the pair of load supporting members, and the both end sides in the direction inclined from the thrust direction of the rotation prevention ball of the second ball coupling mechanism may make a rolling-contact with the pair of rotation prevention supporting members.

Further, the load supporting ball of the first ball coupling mechanism may have a diameter (dimension) larger than that of the rotation prevention ball of the second ball coupling mechanism.

Further, the first and second ball coupling mechanisms may be disposed at a position separated from each other in the peripheral direction of the orbiting scroll.

Further, the first and second ball coupling mechanisms may be disposed at a position separated from each other in the radial direction of the orbiting scroll.

Further, the first ball coupling mechanism may be disposed at at least three positions at an interval in the peripheral direction of the orbiting scroll, and the second ball coupling mechanism may be disposed at at least two positions at an interval in the peripheral direction of the orbiting scroll at a position except on a line passing through the center of the orbiting scroll.

Further, the load supporting member of the first ball coupling mechanism and the rotation prevention supporting member of the second ball coupling mechanism may be integrally formed.

Further, the first ball coupling mechanism may be disposed between the orbiting scroll and the casing, and the second ball coupling mechanism may be disposed between the orbiting scroll and the fixed scroll.

According to embodiments of the present invention, even when the rotation prevention mechanism is applied to a large-sized scroll type fluid machine with an orbiting scroll having large inertia moment, the rotation force can be reliably supported by using the second ball coupling mechanism. As a result, the behavior in the rotational direction of the orbiting scroll is stabilized, whereby the rotation prevention can be reliably achieved.

In addition, the rotation prevention mechanism can separate a function of supporting a thrust load and a function of preventing the rotation. Therefore, the first ball coupling mechanism can be designed based on only the level of the thrust load, and, at the same time, the second ball coupling mechanism can be designed based on only the level of the rotation force. As a result, as with the prior art, the dimensional tolerance of the first and second ball coupling mechanisms can be moderated in comparison with the case in which the two functions of the support of the thrust load on the orbiting scroll and the rotation prevention are used together, and therefore, the manufacturing cost and the management cost can be reduced.

Further, the rotation prevention mechanism can hold a lubricant in each of the first and second ball coupling mechanisms. Therefore, as with the prior art, the lubricant can be easily held in comparison with the case in which the entire rotation prevention mechanism is sealed.

According to one embodiment, a substantially similar effect to the invention according to an aspect of the invention can be obtained. In addition, according to one embodiment, the orbiting scroll can be supported in at least three points by using three pairs of ball coupling mechanisms, whereby the orbiting scroll is prevented from being jounced in the thrust direction and the rotational direction (peripheral direction).

Further, according to one embodiment, a substantially similar effect to the invention according to an aspect of the invention can be obtained. Meanwhile, according to one embodiment, the annular groove makes a rolling-contact with both end sides in the thrust direction of a load supporting ball, whereby the thrust load can be supported. In comparison with the case in which the cross-section of the annular groove is formed linearly, contact stress at the time when the load supporting ball is in contact with the annular groove can be reduced, whereby the life of the first ball coupling mechanism can be extended.

In addition, the peripheral wall of the circular groove makes a rolling-contact with the both end sides in a direction inclined from the thrust direction of the rotation prevention ball, whereby the rotation force of the orbiting scroll can be supported.

Further, according to one embodiment, the thrust load can be reliably supported by the first ball coupling mechanism, and, at the same time, the thrust load acting on the second ball coupling mechanism can be reduced.

Further, according to one embodiment, the rotation force of the orbiting scroll can be reliably supported by the second ball coupling mechanism, and, at the same time, the rotation force acting on the first ball coupling mechanism can be reduced.

Further, according to one embodiment, the both end sides in the thrust direction of the load supporting ball of the first ball coupling mechanism make a rolling-contact with a pair of load supporting members, whereby the thrust load can be supported by the first ball coupling mechanism. Additionally, the both end sides in the direction inclined from the thrust direction of the rotation prevention ball of the second ball coupling mechanism make a rolling-contact with a pair of the rotation prevention supporting members, whereby the rotation force of the orbiting scroll can be supported by the second ball coupling mechanism.

According to one embodiment, the contact area between the load supporting ball and the pair of load supporting members is increased to realize the reduction in the contact stress, whereby the life of the first ball coupling mechanism can be extended.

Further, according to one embodiment, dimension in the radial direction of the orbiting scroll and the casing can be reduced, whereby the entire size of the device can be reduced.

Further, according to one embodiment, additional numbers of the first and second ball coupling mechanisms can be arranged in the peripheral direction. By this, the thrust load and the rotation force acting on each of the first and second ball coupling mechanisms can be reduced, whereby the life of each of the ball coupling mechanisms can be extended.

Further, according to one embodiment, the support of the thrust load and the rotation prevention can be realized with the minimum number of balls.

Further, the rotation torque in all directions can be reliably supported by using the two second ball coupling mechanisms.

Further, according to one embodiment, the load supporting member of the first ball coupling mechanism and the rotation prevention supporting member of the second ball coupling mechanism are integrally formed with each other, whereby the assembly cost of the supporting member and the manufacturing cost can be reduced in comparison with the case in which the two supporting members are separately manufactured.

Further, according to one embodiment, the first and second ball coupling mechanisms can be disposed at an interval in the thrust direction (axis direction), and therefore, the dimension in the radial direction and the peripheral direction of the orbiting scroll and the like can be reduced, whereby the entire size of the device can be reduced.

DESCRIPTION OF THE PREFERRED EMBODIMENTS

Hereinafter, a scroll type fluid machine according to embodiments of this invention is described in detail in accordance with the drawings, using an example in which the scroll type fluid machine is applied to an oilless air compressor.

Figure 1:
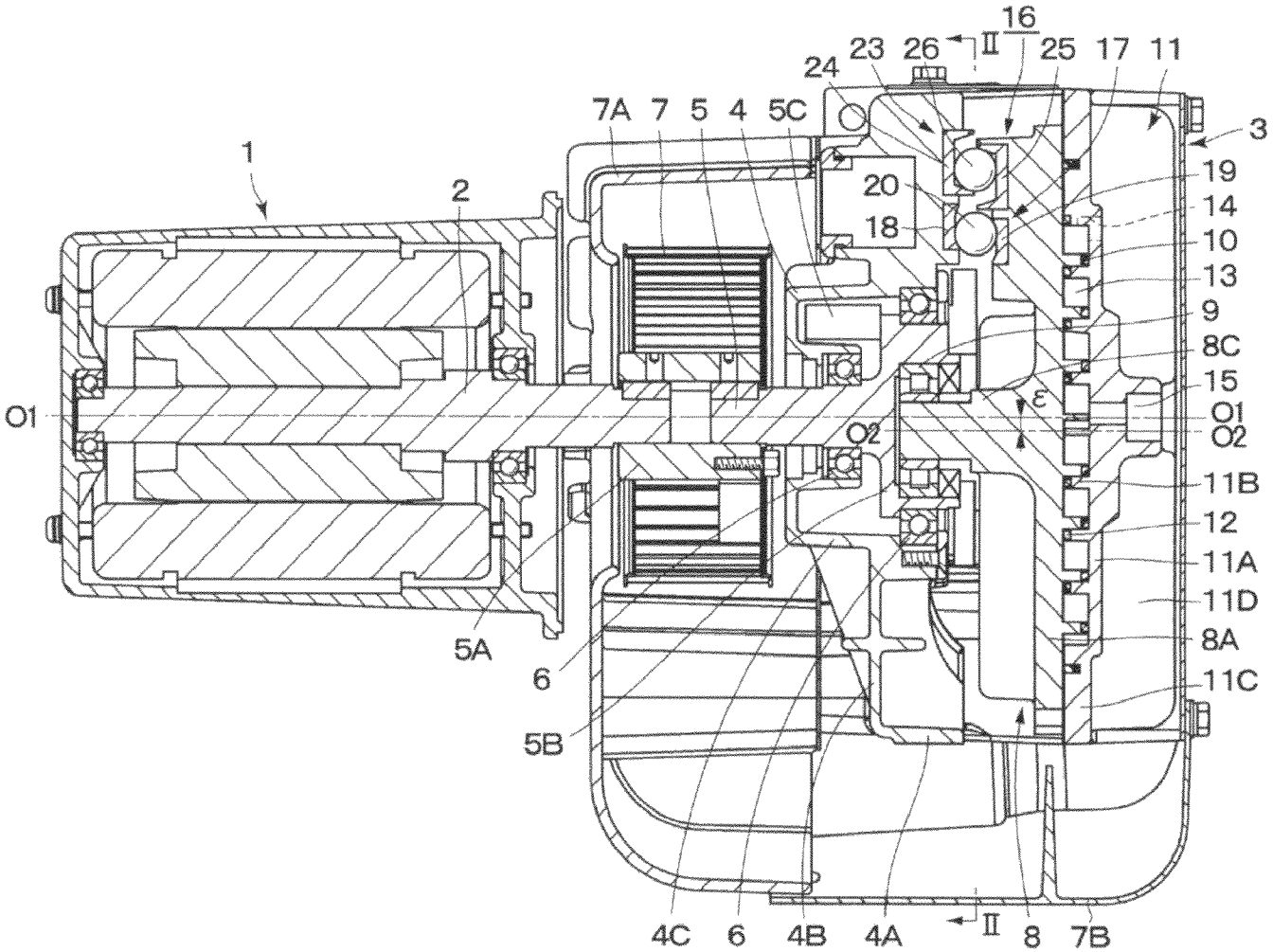
FIG. 1 is a vertical longitudinal sectional view of a scroll type air compressor according to a first embodiment of this invention as viewed from an arrow I-I direction in FIG. 2.
Figure 2:
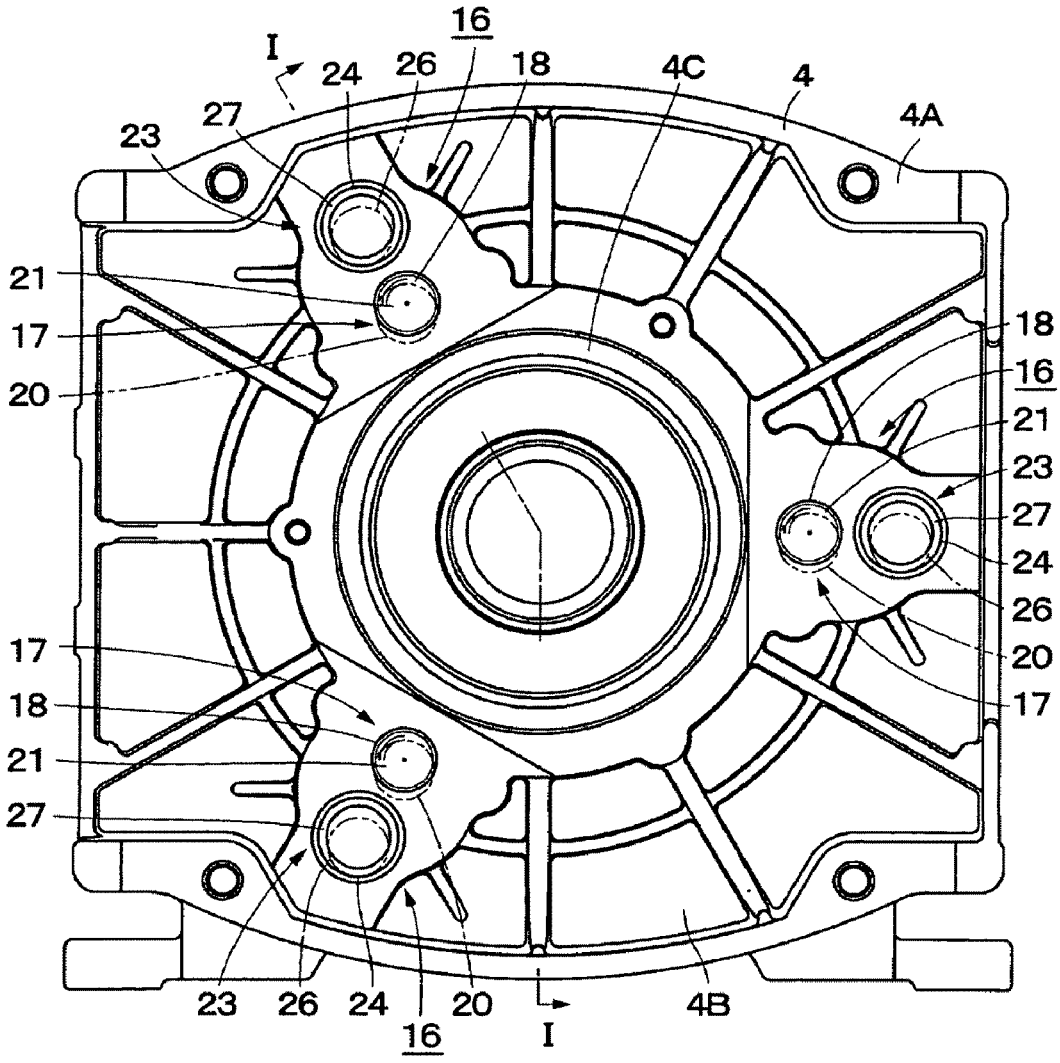
FIG. 2 is a right side view of a part of a casing and a rotation prevention mechanism according to the first embodiment as viewed from an arrow II-II direction in FIG. 1.
Figure 3:
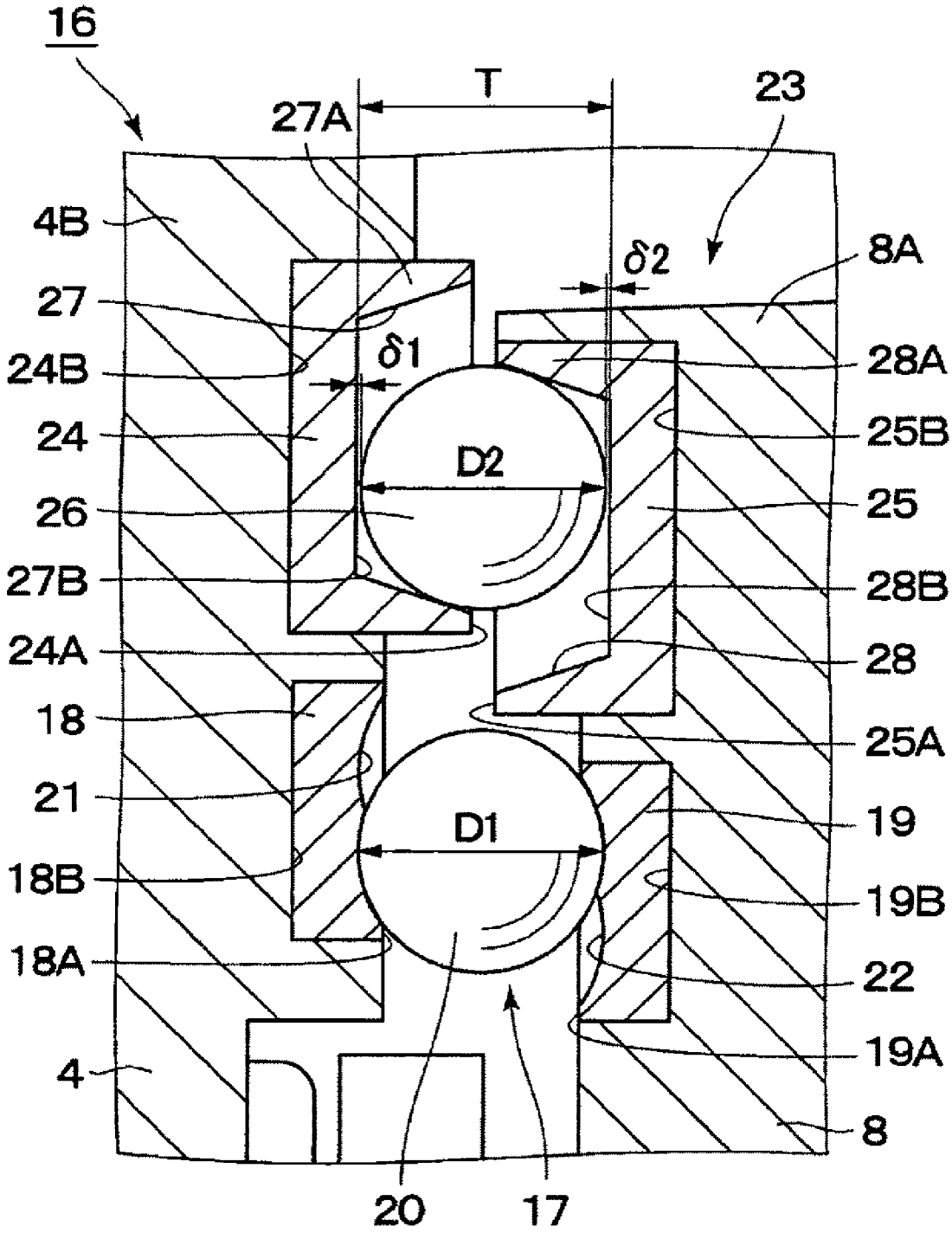
FIG. 3 is an enlarged sectional view of the relevant portion of the rotation prevention mechanism according to the first embodiment.
Figure 4:
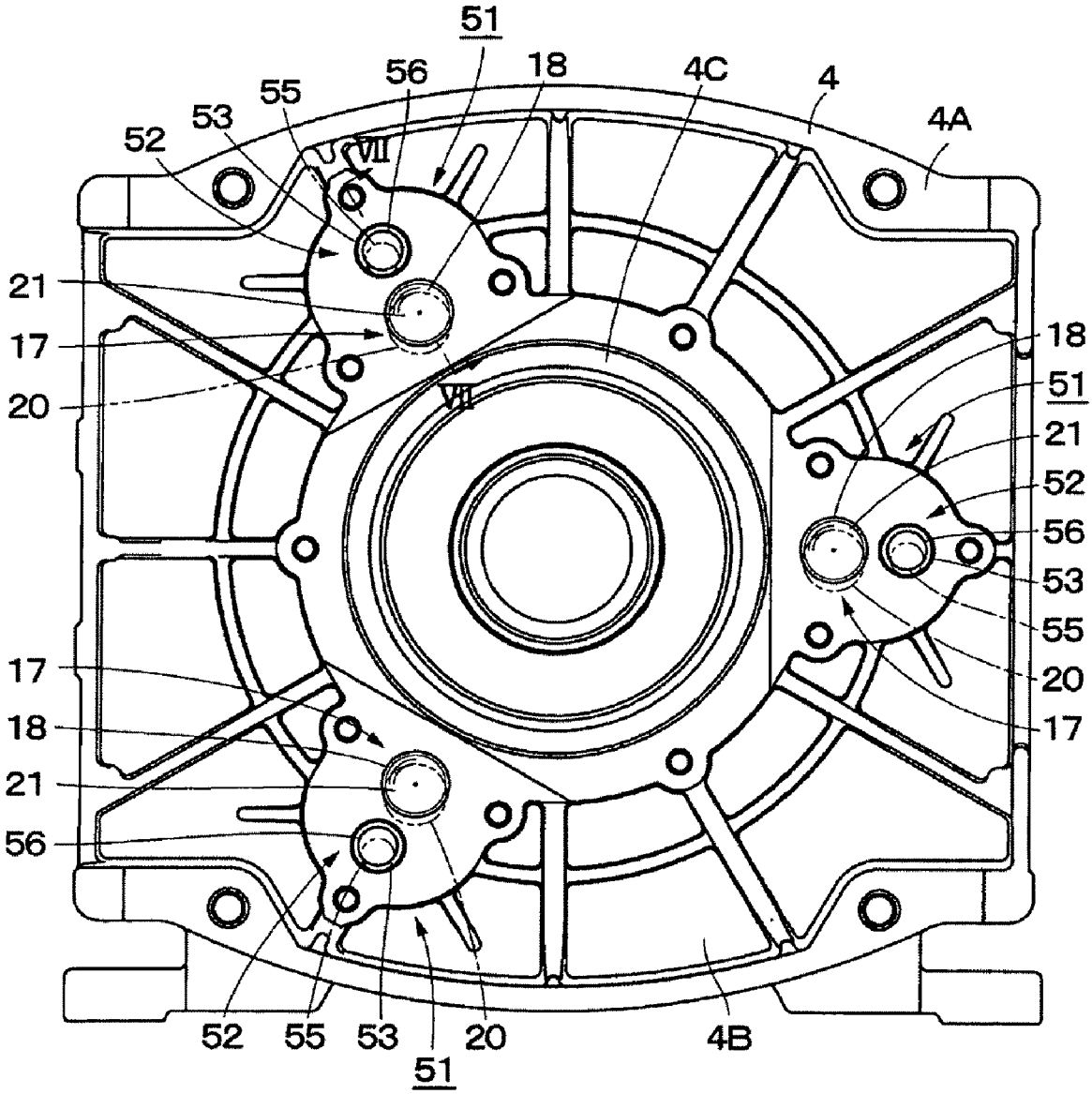
FIG. 4 is a right side view of a part of a casing and rotation prevention mechanism according to a second embodiment as viewed from the same position as in FIG. 2.
Figure 5:
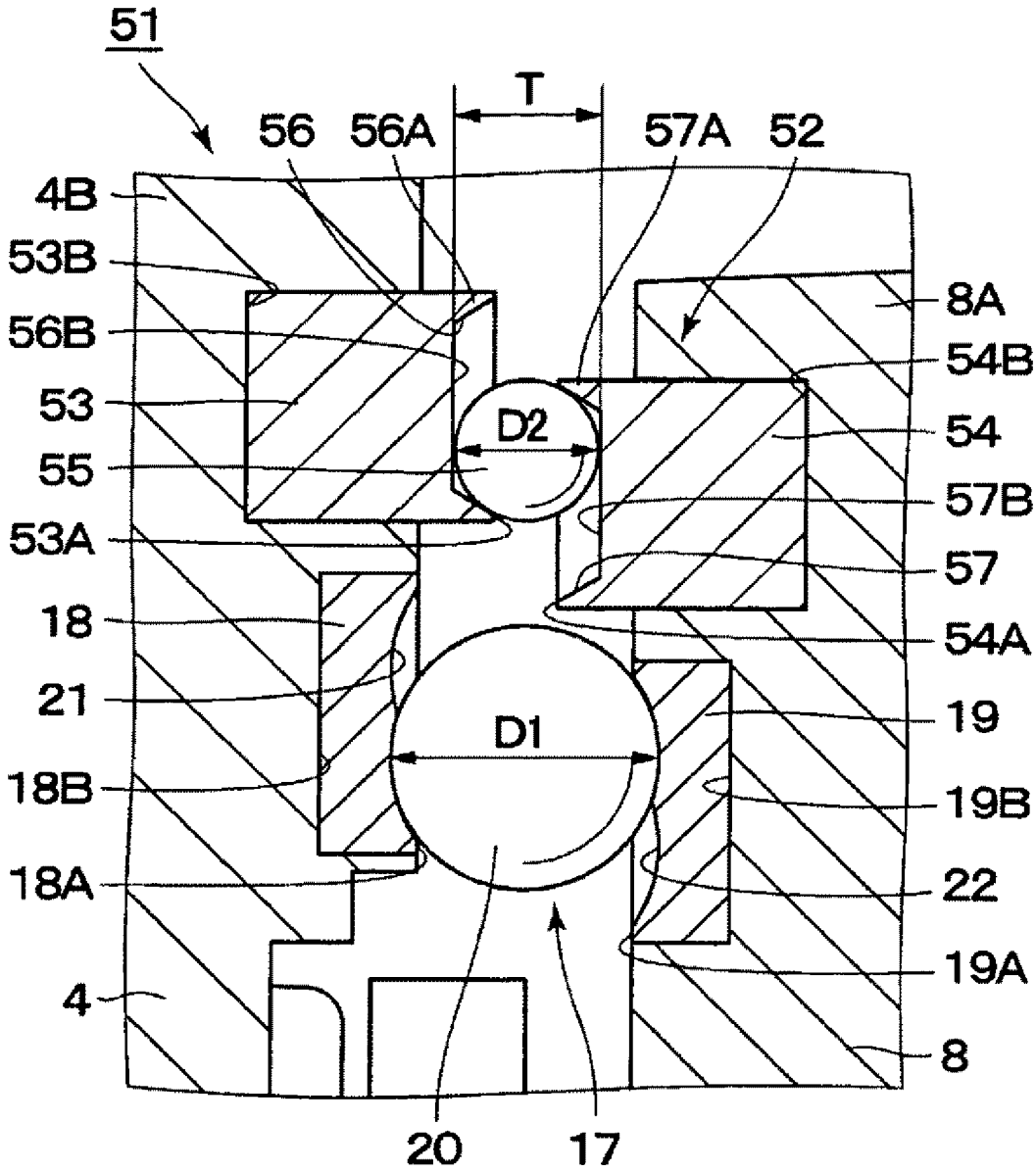
FIG. 5 is an enlarged sectional view of the relevant portion of the rotation prevention mechanism according to the second embodiment as viewed from an arrow VII-VII direction in FIG. 4.

Here, FIGS. 1 to 3 show a first embodiment of the present invention. In the drawings, reference numeral 1 denotes an electric motor constituting a driving source of an air compressor. An output shaft 2 of the electric motor 1 is rotatingly driven to drive a compressor body 3 to be described later.

Reference numeral 3 denotes a compressor body driven by the electric motor 1. The compressor body 3 is constituted of a casing 4 constituting the outer frame, a drive shaft 5, an orbiting scroll 8, a fixed scroll 11, a rotation prevention mechanism 16, and so on (these components will be described later).

In that case, the casing 4 is formed of a metal material such as aluminum and is formed into a bottomed cylindrical shape with an opening on one side in the axis direction. The casing 4 is composed almost of a tubular part 4A, a bottom part 4B provided with another side in the axis direction of the tubular part 4A, and a bearing attachment portion 4C as a large tubular part formed at the center of the bottom part 4B.

The bottom part 4B of the casing 4 has at the position where the bearing attachment portion 4C is surrounded a first attachment recess 18B for attaching a load supporting member 18 of a rotation prevention mechanism 16 to be described later. The bottom part 4B further has at the radial outside of the first attachment recess 18B a second attachment recess 24B for attaching a rotation prevention supporting member 24. The three first and second attachment recesses 18B and 24B, for example, are provided at an interval in the peripheral direction, for example.

Reference numeral 5 denotes a drive shaft rotating around an axial line O1-O1. The drive shaft 5 is rotatably supported with a bearing 6 provided in the bearing attachment portion 4C of the casing 4. In addition, the drive shaft 5 is removably coupled with the output shaft 2 of the electric motor 1 with the use of a shaft coupling 5A. The drive shaft 5 further has on one side in the axis direction a tubular crank part 5B eccentric from the axis line of the drive shaft 5 by a constant dimension. A connecting shaft part 8C of an orbiting scroll 8 to be described later and an orbit bearing 9 are attached to the crank part 5B. A balance weight 5C is integrally formed on the outer peripheral side of the drive shaft 5 in order to stabilize the orbiting motion of the orbiting scroll 8.

Reference numeral 7 denotes a cooling fan formed of a centrifugal fan. The cooling fan 7 is located on the outer peripheral side of the drive shaft 5 and attached onto another side in the axis direction of the drive shaft 5. The cooling fan 7 is accommodated in a fan casing 7A, and, at the same time, the inside of the fan casing 7A communicates with a duct 7B attached onto the outer peripheral side of the casing 4. According to this constitution, the cooling fan 7 supplies cooling air toward the orbit bearing 9 and so on located in the casing 4 through the fan casing 7A and the duct 7B.

Reference numeral 8 denotes an orbiting scroll located in the casing 4 and rotatably provided in the drive shaft 5. The orbiting scroll 8 is constituted of a disk-shaped end plate 8A with an axis line O2-O2 as the center, a spiral wrap portion 8B provided upright with the surface of the end plate 8A, and the connecting shaft part 8C provided to project from the center of the rear surface of the end plate 8A and rotatably attached to the crank part 5B of the drive shaft 5 through the orbit bearing 9.

Here, the axis line O2-O2 as the center of the connecting shaft part 8C of the orbiting scroll 8 is disposed eccentric from the axis line O1-O1, which is the center of an fixed scroll 11 to be described later, in a radial direction by a dimension $\epsilon$ predetermined by the crank part 5B of the drive shaft 5. Meanwhile, a sealing member 10 extending in a string shape along the spiral shape of the wrap portion 8B is attached to the top of the wrap portion 8B. The sealing member 10 seals between the top of the wrap portion 8B and an end plate 11A of the fixed scroll 11.

Further, the orbiting scroll 8 has on its outer diameter side of the rear surface part a first attachment recess 19B for attaching a load supporting member 19 of a rotation prevention mechanism 16 to be described later and a second attachment recess 25B for attaching a rotation prevention supporting member 25. The three first and second attachment recesses 19B and 25B, for example, are provided at an interval in the peripheral direction, for example. In addition, the first and second attachment recesses 19B and 25B are respectively disposed at a position opposed to the first and second attachment recesses 18B and 24B of the casing 4. Therefore, the second attachment recess 25B is located on the more outer side in the radial direction than the first attachment recess 19B.

Reference numeral 11 denotes a fixed scroll, which constitutes a fixed side member of a compressor in cooperation with the casing 4. The fixed scroll 11 is attached onto the opening side of the casing 4 in the state of being opposed to the orbiting scroll 8.

The fixed scroll 11 is constituted of the disk-shaped end plate 11A disposed coaxially with the drive shaft 5, a spiral wrap portion 11B provided upright with the surface of the end plate 11A, and a flange part 11C provided with the outer peripheral side of the end plate 11A so as to surround the wrap portion 11B and attached onto the opening end side of the casing 4. In addition, plural radiating fins 11D are provided upright with the rear surface side of the end plate 11A. Further, a sealing member 12 is attached to the top end of the wrap portion 11B for the purpose of sealing between the top end of the wrap portion 11B and the end plate 8A of the orbiting scroll 8.

Additionally, plural compression chambers 13 which are fluid chambers located between each of the wrap portions 11B and 8B are defined between the fixed scroll 11 and the orbiting scroll 8. When the drive shaft 5 is driven to rotate, the scroll type arid compressor is revolved in such a state that the rotation of the orbiting scroll 8 is regulated by the rotation prevention mechanism 16 to be described later, and turns relative to the fixed scroll 11. By this, the air compressor sucks air into the compression chamber 13 provided with the outer peripheral side to sequentially compress the air in each of the compression chamber 13, and, at the same time, to transfer the air toward the center side.

Reference numeral 14 denotes two suction openings provided with the outer peripheral side of the fixed scroll 11. Each of the suction openings 14 communicates with the compression chamber 13 on the outer peripheral side and supplies external air in the compression chamber 13.

Reference numeral 15 denotes a discharge opening provided with the center side of the fixed scroll 11. The discharge opening 15 communicates with the compression chamber 13 on the center side and discharges to the outside the air compressed in accordance with the movement of the compression chamber 13 from the outer peripheral side to the center side.

Reference numeral 16 denotes a rotation prevention mechanism provided between a bottom part 4B of the casing 4 and the rear surface side of the orbiting scroll 8. The rotation prevention mechanism 16 is constituted of a first ball coupling mechanism 17 for supporting a thrust load and a second ball coupling mechanism 23 for preventing the rotation of the orbiting scroll 8. For example, three pairs of the rotation prevention mechanisms 16 are constituted of a pair of the first and second ball coupling mechanisms 17 and 23. These three pairs of rotation prevention mechanisms 16 are arranged on the outer peripheral side of the bearing attachment portion 4C at a substantially equal interval (about a 120 degree interval) in the peripheral direction with the drive shaft 5 as the center.

Reference numeral 17 denotes a first ball coupling mechanism for supporting the thrust load. The first ball coupling mechanism 17 includes a pair of load supporting members 18 and 19 provided so that ball support surfaces 18A and 19A are opposed to each other between the casing 4 and the orbiting scroll 8 and a load supporting ball 20 provided between the pair of load supporting members 18 and 19 and supporting a load in a thrust direction.

Here, the load supporting ball 20 is formed of a spherical body formed of a material having a high rigidity such as a steel ball and receives on the bottom part 4B side of the casing 4 the thrust load added to the end plate 8A of the orbiting scroll 8 and so on in cooperation with the load supporting members 18 and 19.

The first load supporting member 18 is formed of, for example, a disk-shaped plate body and attached to the first attachment recess 18B of the casing 4. Meanwhile, the second load supporting member 19 is formed of, for example, a disk-shaped plate body and attached to the first attachment recess 19B of the orbiting scroll 8 at the position facing the first load supporting member 18 in the axis direction.

Further, annular grooves 21 and 22 are 4 respectively provided in ball support surfaces 18A and 19A of the load supporting members 18 and 19. Here, the load supporting ball 20 rolls along a predetermined circular locus in accordance with the orbiting motion of the orbiting scroll 8, and therefore, the annular grooves 21 and 22 are provided along the circular locus of the load supporting ball 20.

The annular grooves 21 and 22 make a rolling-contact with the both end sides in the thrust direction of the load supporting ball 20, and, at the same time, the cross section at the contact position is formed in the shape of an arc. Here, the curvature radius of the cross section of the annular grooves 21 and 22 is set to be larger than the radius of the load supporting ball 20 (half of diameter D1). By this, the annular grooves 21 and 22 reduce the contact stress between the load supporting members 18 and 19 and the load supporting ball 20.

The annular grooves 21 and 22 are formed to have a small depth and are less likely to contact with the position other than the both end sides in the thrust direction of the load supporting ball 20. Therefore, when the rotation force acts on the orbiting scroll 8, the second ball coupling mechanism 23 receives a larger rotation force than the first ball coupling mechanism 17.

Reference numeral 23 denotes a second ball coupling mechanism for preventing the rotation of the orbiting scroll 8. The second ball coupling mechanism 23 includes a pair of rotation prevention supporting members 24 and 25 provided so that ball support surfaces 24A and 25A are opposed to each other between the casing 4 and the orbiting scroll 8 and a rotation prevention ball 26 provided between the pair of rotation prevention supporting members 24 and 25 and preventing the rotation of the orbiting scroll 8.

The first rotation prevention supporting member 24 is formed of, for example, a disk-shaped plate body and attached to the second attachment recess 24B of the casing 4. Meanwhile, the second rotation prevention supporting member 25 is formed of, for example, a disk-shaped plate body and attached to the second attachment recess 25B of the orbiting scroll 8 at the position facing the first rotation prevention supporting member 24 in the axis direction.

Further, circular grooves 27 and 28 are respectively provided in the ball support surfaces 24A and 25A of the rotation prevention supporting members 24 and 25. Here, the circular grooves 27 and 28 have annular peripheral walls 27A and 28A protruding in the axis direction. The peripheral walls 27A and 28A are expanded in a tapered shape toward the opening side. The inner peripheral surfaces of the peripheral walls 27A and 28A make rolling-contact with the both end sides in the direction inclined from the thrust direction of the rotation prevention ball 26, and, at the same time, the cross section at the contact position is formed linearly.

According to the above constitution, the peripheral walls 27A and 28A can act a force in a direction perpendicular to the thrust direction (radial direction and peripheral direction) on the rotation prevention ball 26. Therefore, the rotation force of the orbiting scroll 8 can be supported on the bottom part 4B side of the casing 4 by using the rotation prevention ball 26 and the rotation prevention supporting members 24 and 25.

The circular grooves 27 and 28 guide the rotation prevention ball 26 along a predetermined circular locus in accordance with the orbiting motion of the orbiting scroll 8. At this time, for example, the rotation prevention ball 26 corresponds to the equatorial position where the position making a rolling-contact with the peripheral walls 27A and 28A is perpendicular to the rotation axis.

The rotation prevention ball 26 is formed of a spherical body made from a material having a high rigidity such as a steel ball as with the load supporting ball 20. The diameter D2 of the rotation prevention ball 26 is set to be the same as the diameter D1 of the load supporting ball 20 (D2=D1).

However, the diameter D2 of the rotation prevention ball 26 is set to be smaller than a clearance dimension T between the bottom surfaces 27B and 28B (D2<T). By this, the both end sides in the thrust direction of the rotation prevention ball 26 are spaced from the bottom surfaces 27B and 28B of the circular grooves 27 and 28, and spaces of minimal dimensions δ1 and δ2 are respectively formed between the rotation prevention ball 26 and the bottom surface 27B, and between the rotation prevention ball 26 and the bottom surface 28B. As a result, when the load in the thrust direction acts on the orbiting scroll 8, the first ball coupling mechanism 17 receives a larger load than the second ball coupling mechanism 23.

The first and second ball coupling mechanisms 17 and 23 may have a grease cover (not shown) surrounding each of the balls 20 and 26. According to this constitution, the grease can be easily held around the balls 20 and 26. Meanwhile, the entire pair of rotation prevention mechanisms 16 may be surrounded by the grease cover.

The scroll type air compressor according to the present embodiment has the above constitution. Next, the operation is described.

When an electric power is supplied to the electric motor 1 from the outside to drive to rotate the drive shaft 5 around the axis line O1-O1 with the aid of the output shaft 2, the orbiting scroll 8 rotates with a predetermined orbiting radius (dimension ϵ in FIG. 1) in such a state that the rotation of the orbiting scroll 8 is regulated by, for example, the three pairs of rotation prevention mechanisms 16.

By the above constitution, each compression chamber 13 defined between the wrap portion 11B of the fixed scroll 11 and the wrap portion 8B of the orbiting scroll 8 is continuously reduced from the outer diameter side toward the inner diameter side. The compression chambers 13 on the outer diameter side suck air through a suction opening 14 provided with the outer peripheral side of the fixed scroll 11 to sequentially compress the air in each of the compression chambers 13, and, at the same time, the compressed air is discharged from the compression chambers 13 on the inner peripheral side to the outside through a discharge opening 15.

In the above compression operation, the pressure of the air compressed in each of the compression chambers 13 becomes a thrust load to act on the end plate 8A of the orbiting scroll 8. However, three pairs of the rotation prevention mechanisms 16, for example, are disposed between the bottom part 4B of the casing 4 and the rear surface side of the orbiting scroll 8, and these rotation prevention mechanisms 16 are constituted of the first and second ball coupling mechanisms 17 and 23.

Therefore, the thrust load added to the end plate 8A of the orbiting scroll 8 can be received between the first and second load supporting members 18 and 19 of the first ball coupling mechanism 17 and the load supporting ball 20. According to this constitution, the orbiting scroll 8 can be prevented from being displaced in the axis direction of the casing 4 and inclined obliquely to the fixed scroll 11, whereby the orbiting motion of the orbiting scroll 8 can be stabilized.

Meanwhile, the rotation force of the orbiting scroll 8 can be received between the first and second rotation prevention supporting members 24 and 25 of the second ball coupling mechanism 23 and the rotation prevention ball 26. According to this constitution, even when the orbiting scroll 8 is applied to a large scroll type fluid machine with large inertia moment, the rotation force of the orbiting scroll 8 can be reliably supported by using the second ball coupling mechanism 23. As a result, the behavior in the rotational direction of the orbiting scroll 8 is stabilized, whereby the rotation prevention can be reliably realized.

In addition, the rotation prevention mechanism 16 is constituted of the first and second ball coupling mechanisms 17 and 23, and therefore, a function of supporting the thrust load and a function of preventing the rotation can be separated from each other by using the first and second ball coupling mechanisms 17 and 23. Therefore, the first ball coupling mechanism 17 can be designed based on only the level of the thrust load, and, at the same time, the second ball coupling mechanism 23 can be designed based on solely the level of the rotation force. As a result, as with the prior art, the dimensional tolerance of the first and second ball coupling mechanisms 17 and 23 can be moderated in comparison with the case in which the two functions of the support of the thrust load on the orbiting scroll 8 and the rotation prevention are used together, thereby to reduce the manufacturing cost and the management cost.

Further, the rotation prevention mechanism 16 is constituted of the first and second ball coupling mechanisms 17 and 23, and therefore, a lubricant such as grease can be held in each of the first and second ball coupling mechanisms 17 and 23. Therefore, as with the prior art, the lubricant can be easily held in comparison with the case in which the entire rotation prevention mechanism is sealed.

In addition, the rotation prevention mechanism 16 is constituted of the first and second ball coupling mechanisms 17 and 23, and therefore, the load supporting ball 20 makes a rolling-contact with the support members 18 and 19, and, at the same time, the rotation prevention ball 26 makes a rolling-contact with the support members 24 and 25. Therefore, the power loss can be reduced in comparison with a mechanism in which a guide and a slider are slidingly contacted with each other to prevent the rotation of the orbiting scroll, such as an Oldham's coupling.

Three pairs of the first and second ball coupling mechanisms 17 and 23 are located on the outer peripheral side of the orbiting scroll 8 and disposed at an interval in the peripheral direction. Therefore, the orbiting scroll 8 can be supported at three positions by using these three pairs of the first and second ball coupling mechanisms 17 and 23, whereby the orbiting scroll 8 is prevented from being jounced in the thrust direction and the rotational direction (peripheral direction). In addition, these three pairs of rotation prevention mechanisms 16 are disposed at an interval in the peripheral direction, whereby a cooling air can be supplied to the orbit bearing 9 and so forth through between the two adjacent pairs of rotation prevention mechanisms 16.

Further, the annular grooves 21 and 22 are provided in the ball support surfaces 18A and 19A of the pair of the load supporting members 18 and 19, and therefore, the annular grooves 21 and 22 make a rolling-contact with the both end sides in the thrust direction of the load supporting ball 20, whereby the thrust load can be supported. The annular grooves 21 and 22 are formed to have an arc-shaped cross section. Therefore, in comparison with the case in which the annular grooves 21 and 22 are formed to have a linear cross section, the contact stress at the time when the load supporting ball 20 is in contact with the annular grooves 21 and 22 can be reduced, thereby to extend the life of the first ball coupling mechanism 17.

Meanwhile, the circular grooves 27 and 28 are provided in the ball support surfaces 24A and 25A of the pair of the rotation prevention support members 24 and 25. Therefore, the peripheral walls 27A and 28A of the circular grooves 27 and 28 make a rolling-contact with the both end sides in a direction inclined from the thrust direction of the rotation prevention ball 26, thereby to support the rotation force of the orbiting scroll 8.

Further, when the load in the thrust direction acts on the orbiting scroll 8, the load supported by the first ball coupling mechanism 17 is larger than the second ball coupling mechanism 23. According to this constitution, the thrust load can be reliably supported by the first ball coupling mechanism 17, and, at the same time, the thrust load acting on the second ball coupling mechanism 23 can be reduced.

Further, when the rotation force acts on the orbiting scroll 8, the rotation force received by the second ball coupling mechanism 23 is configured to be larger than the first ball coupling mechanism 17. By this, the rotation force of the orbiting scroll 8 can be reliably supported by the second ball coupling mechanism 23, and, at the same time, the rotation force acting on the first ball coupling mechanism 17 can be reduced.

Further, the first and second ball coupling mechanisms 17 and 23 are disposed at a position spaced in the radial direction of the orbiting scroll 8, and therefore, in comparison with the case in which the first and second ball coupling mechanisms 17 and 23 are disposed at a position spaced in the peripheral direction, additional numbers of the first and second ball coupling mechanisms 17 and 23 can be disposed in the peripheral direction. According to this constitution, the thrust load and the rotation force acting on each of the first and second ball coupling mechanisms 17 and 23 can be reduced, whereby life of each of the ball coupling mechanisms 17 and 23 can be extended.

Here, the first and second ball coupling mechanisms 17 and 23 may be disposed at a position spaced in the peripheral direction of the orbiting scroll 8.

Figure 6:
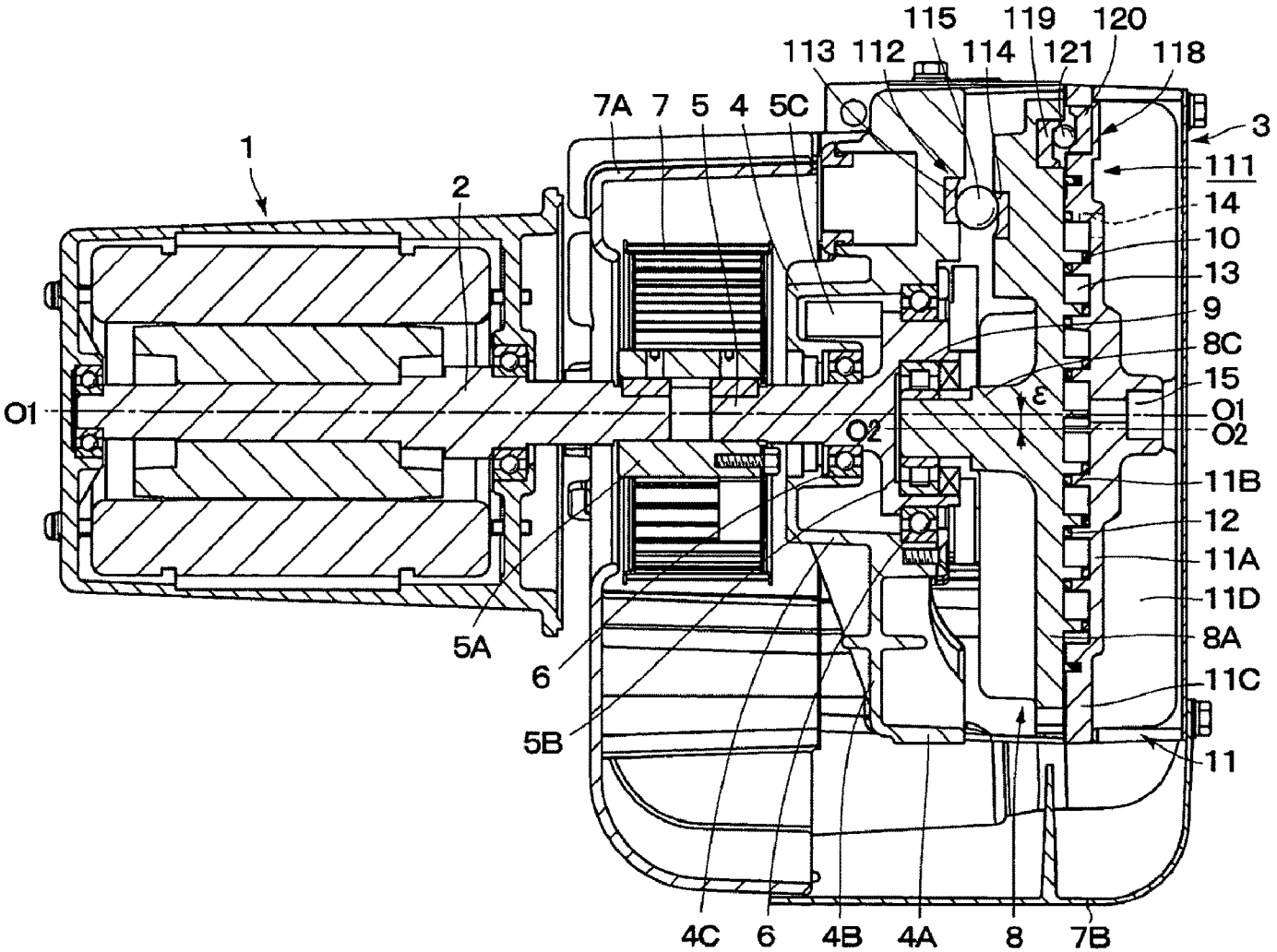
FIG. 6 is a vertical longitudinal sectional view of a scroll type air compressor according to a third embodiment as viewed from the same position as in FIG. 1.
Figure 7:
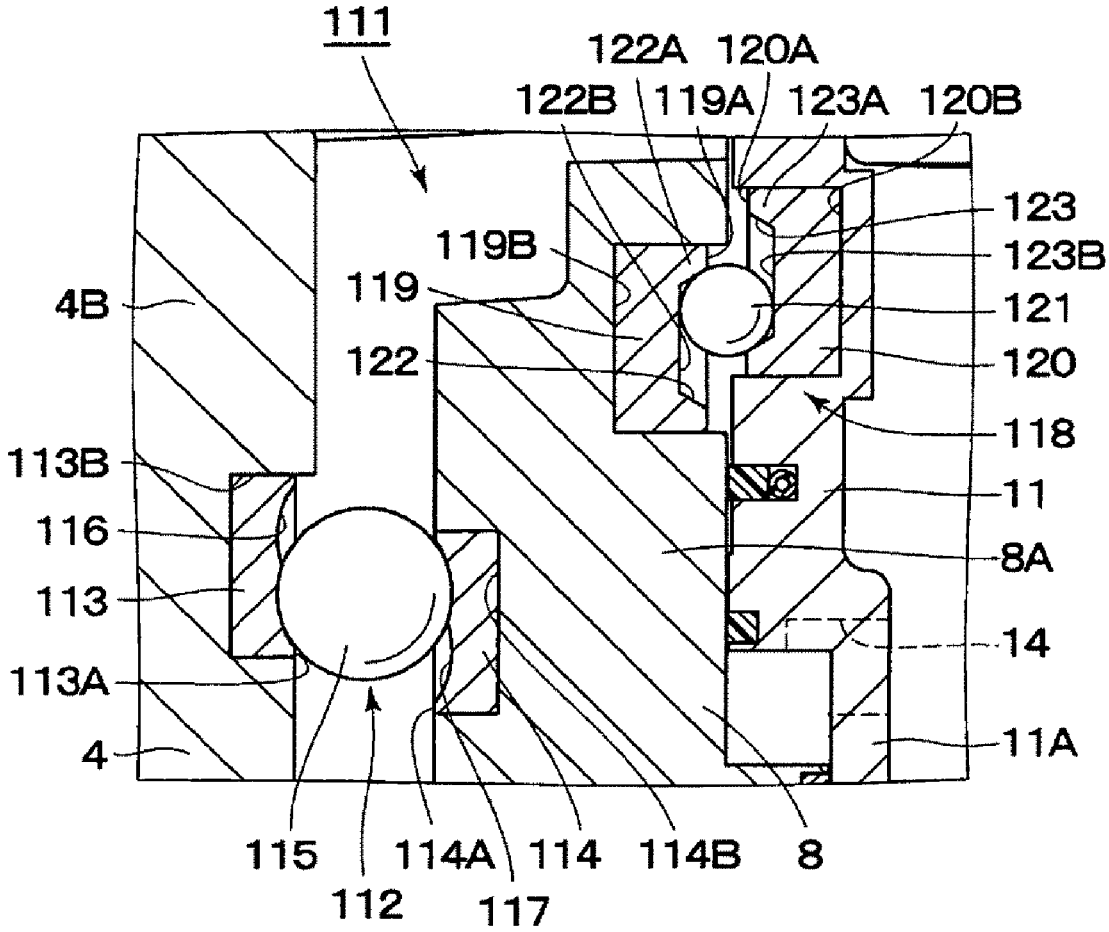
FIG. 7 is an enlarged sectional view of the relevant portion of a rotation prevention mechanism according to the third embodiment.

FIGS. 6 and 7 show a third embodiment of this invention. This embodiment is characterized in that a load supporting ball of a first ball coupling mechanism has a larger diameter (dimension) than a rotation prevention ball of a second ball coupling mechanism. In this embodiment, the same components as those in the first embodiment are assigned with the same reference numerals, thus description will not be repeated here.

In the drawings, reference numeral 51 denotes a rotation prevention mechanism according to this embodiment. As with the rotation prevention mechanism 16 in the first embodiment, the rotation prevention mechanism 51 is constituted of first and second ball coupling mechanisms 17, 52, etc. The rotation prevention mechanism 51 is formed, for example, in three pairs, with the first ball coupling mechanisms 17 and the second ball coupling mechanisms 25 making each pair. These three pairs of rotation prevention mechanisms 51 are located on the outer peripheral side of a bearing attachment portion 4C of a casing 4 and disposed at a substantially equal interval (about a 120 degree interval) in the peripheral direction with the bearing attachment portion 4C as the center.

Reference numeral 52 denotes a second ball coupling mechanism for preventing the rotation of an orbiting scroll 8. As with the second ball coupling mechanism 23 in the first embodiment, the second ball coupling mechanism 52 includes a pair of rotation prevention supporting members 53 and 54 provided so that ball support surfaces 53A and 54A are opposed to each other between the casing 4 and the orbiting scroll 8 and a rotation prevention ball 55 provided between the pair of rotation prevention supporting members 53 and 54 and preventing the rotation of the orbiting scroll 8.

The first rotation prevention supporting member 53 is formed of, for example, a disk-shaped plate body and attached to a second attachment recess 53B of the casing 4. Meanwhile, the second rotation prevention supporting member 54 is formed of, for example, a disk-shaped plate body and attached to a second attachment recess 54B of the orbiting scroll 8 at the position facing the first rotation prevention supporting member 53 in the axis direction.

Further, circular grooves 56 and 57 are respectively provided in the ball support surfaces 53A and 54A of the rotation prevention supporting members 53 and 54. Here, the circular grooves 56 and 57 have annular peripheral walls 56A and 57A protruding in the axis direction. The inner peripheral surfaces of the peripheral walls 56A and 57A make a rolling-contact with the both end sides in the direction inclined from the thrust direction of the rotation prevention ball 55.

The rotation prevention ball 55 is formed of a spherical body made from a material having a high rigidity such as a steel ball as with the load supporting ball 20. The diameter D2 of the rotation prevention ball 55 is set to be smaller than a clearance dimension T between bottom surfaces 56B and 57B ($D2<T$). Meanwhile, the diameter D1 of the load supporting ball 20 is set to be larger than the diameter D2 of the rotation prevention ball 55 ($D1>D2$).

This embodiment having the above constitution can also obtain a substantially similar operational effect to the first embodiment. Particularly, in this embodiment, the diameter D1 of the load supporting ball 20 of the first ball coupling mechanism 17 is larger than the diameter D2 of the rotation support ball 55 of the second ball coupling mechanism 52. Accordingly, the contact area between the load supporting ball 20 and the pair of the load support members 18 and 19 can be increased so as to reduce the contact stress, whereby the life of the first ball coupling mechanism 17 can be extended.

In doing this, two second ball coupling mechanisms 62 may be provided around one first ball coupling mechanism 17.

Also, six first ball coupling mechanisms 17 may be provided so as to surround one second ball coupling mechanism 62.

Further, the first ball coupling mechanisms 17 may be disposed at three positions at an interval in the peripheral direction of the orbiting scroll 8, and the second ball coupling mechanisms 62 may be disposed at two positions at an interval in the peripheral direction of the orbiting scroll 8 so that each should be located at a position except on a line passing through the center of the orbiting scroll 8.

FIGS. 6 and 7 show a third embodiment of this invention. This embodiment is characterized in that first ball coupling mechanisms are disposed at three positions at an interval in the peripheral direction of an orbiting scroll and second ball coupling mechanisms are disposed at two positions at an interval in the peripheral direction of the orbiting scroll at a position except on a line passing the center of the orbiting scroll. In this embodiment, the same components as those in the first embodiment are assigned with the same reference numerals, thus description will not be repeated here.

In the drawings, reference numeral 111 denotes a rotation prevention mechanism according to this embodiment. The rotation prevention mechanism 111 is constituted of first and second ball coupling mechanisms 112 and 118, as with the rotation prevention mechanism 16 in the first embodiment.

Reference numeral 112 denotes a first ball coupling mechanism according to this embodiment. The first ball coupling mechanism 112 includes a pair of load supporting members 113 and 114 provided so that ball support surfaces 113A and 114A are opposed to each other between a casing 4 and an orbiting scroll 8 and a load supporting ball 115 provided between the pair of load supporting members 113 and 114 and supporting the load in a thrust direction, in almost the same way as the first ball coupling mechanism 17 in the first embodiment.

The first load supporting member 113 is formed of, for example, a disk-shaped plate body and attached to a first attachment recess 113B of the casing 4. Meanwhile, the second load supporting member 114 is formed of, for example, a disk-shaped plate body and attached to a first attachment recess 114B of the orbiting scroll 8 at the position facing the first load supporting member 113 in the axis direction.

Further, annular grooves 116 and 117 are respectively provided in the ball support surface 113A and 114A of the load supporting members 113 and 114. The annular grooves 116 and 117 make a rolling-contact with the both end sides in the thrust direction of a load supporting ball 115.

The first ball coupling mechanisms 112 are provided at three positions on the outer peripheral side of a bearing attachment portion 4C of the casing 4. These three first ball coupling mechanisms 112 are disposed at a substantially equal interval (about a 120 degree interval) in the peripheral direction with the bearing attachment portion 4C as the center.

Reference numeral 118 denotes a second ball coupling mechanism for preventing the rotation of the orbiting scroll 8. The second ball coupling mechanism 118 includes a pair of rotation prevention supporting members 119 and 120 provided so that ball support surfaces 119A and 120A are opposed to each other between a fixed scroll 11 and the orbiting scroll 8 and a rotation prevention ball 121 provided between the pair of rotation prevention supporting members 119 and 120 and preventing the rotation of the orbiting scroll 8.

The first rotation prevention supporting member 119 is formed of, for example, a disk-shaped plate body and attached to a second attachment recess 119B of the orbiting scroll 8. Meanwhile, the second rotation prevention supporting member 120 is formed of, for example, a disk-shaped plate body and attached to a second attachment recess 120B of the fixed scroll 11 at the position facing the first rotation prevention supporting member 119 in the axis direction.

Further, circular grooves 122 and 123 are respectively formed in the ball support surfaces 119A and 120A of the rotation prevention supporting members 119 and 120. Here, the circular grooves 122 and 123 have annular peripheral walls 122A and 123A protruding in the axis direction. The inner peripheral surfaces of the peripheral walls 122A and 123A make a rolling-contact with the both end sides in the direction inclined from the thrust direction of the rotation prevention ball 121. The diameter of the rotation prevention ball 121 is set to be smaller than the diameter of the load supporting ball 115, and, at the same time, set to be smaller than a clearance dimension between bottom surfaces 122B and 123B.

The second ball coupling mechanisms 118 are provided at three positions on the outer peripheral side of the fixed scroll 11. These three second ball coupling mechanisms 118 are disposed at a substantially equal interval (about a 120 degree interval) in the peripheral direction.

This embodiment having the above constitution can also obtain a substantially similar operational effect to the first embodiment. Particularly, in this embodiment, the first ball coupling mechanism 112 is disposed between the orbiting scroll 8 and the casing 4, and the second ball coupling mechanism 118 is disposed between the orbiting scroll 8 and the fixed scroll 11. Therefore, the first and second ball coupling mechanisms 112 and 118 can be disposed to be spaced from each other in the thrust direction (axis direction), and therefore, the dimension in the radial direction and the peripheral direction of the orbiting scroll 8 and so on can be reduced, so as to achieve downsizing of the entire device.

Figure 8:
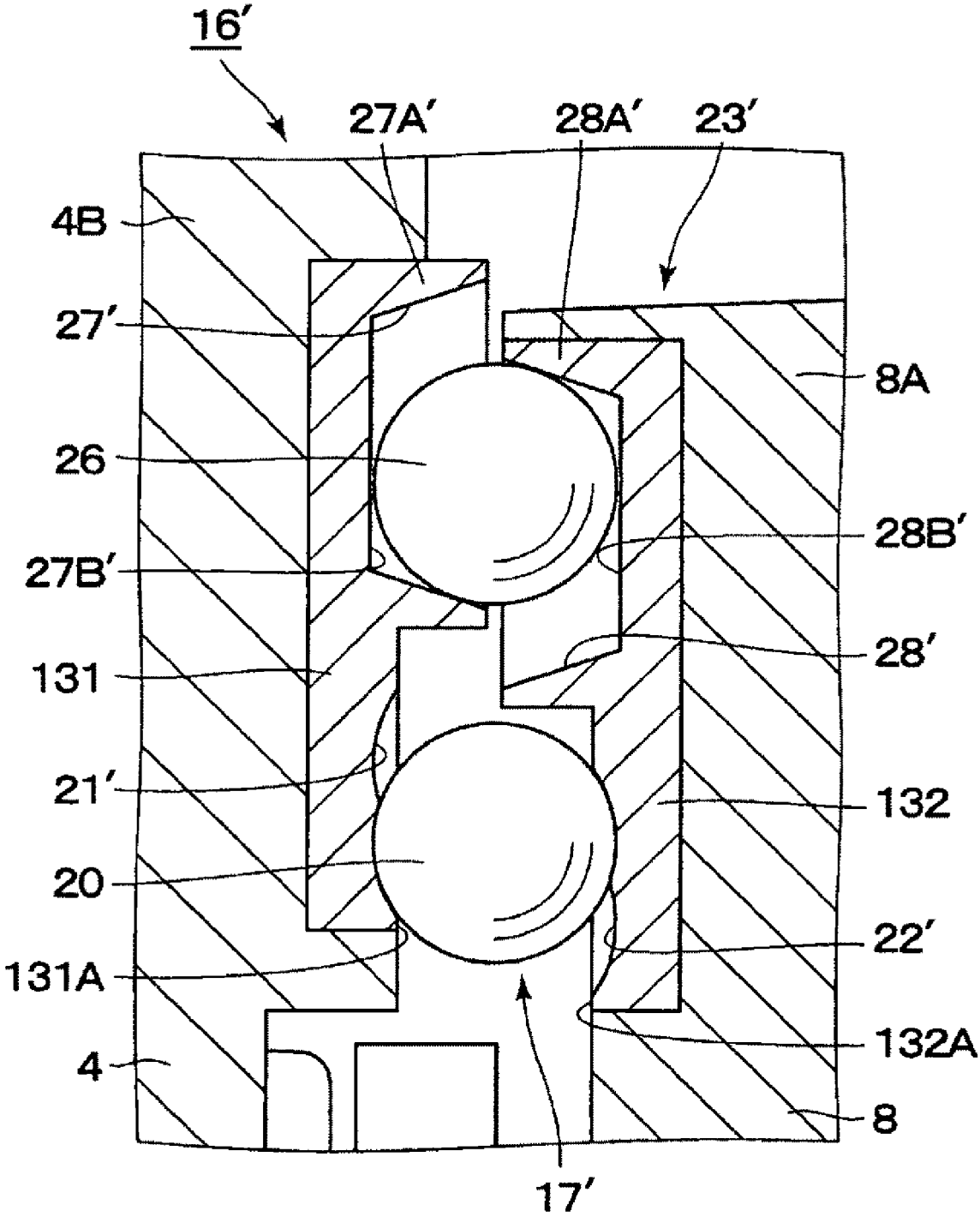
FIG. 8 is an enlarged sectional view of the relevant portion of a rotation prevention mechanism according to a variation as viewed from the same position as in FIG. 3.

In the first embodiment, the load supporting members 18 and 19 of the first ball coupling mechanism 17 and the rotation prevention supporting members 24 and 25 of the second ball coupling mechanism 23 are formed of a different member. However, as a variation shown in FIG. 8, for example, when a second ball coupling mechanism 23' is disposed around a first ball coupling mechanism 17', supporting members 131 and 132 in which a load supporting member and a rotation prevention supporting member are integrated with each other may be used. In this case, annular grooves 21' and 22' and circular grooves 27' and 28' are formed in ball support surfaces 131A and 132A of supporting members 131 and 132. By this, the assembly cost of the supporting members 131 and 132 and the manufacturing cost can be reduced in comparison with the case in which the load supporting member and the rotation prevention supporting member are separately manufactured. Such a constitution can be similarly applied to other embodiments.

In addition, in the first embodiment, the supporting members 18, 19, 24, and 25 are formed of a member different from the casing 4, the orbiting scroll 8, and the fixed scroll 11 to which these supporting members will be attached. However, the present invention is not limited to this. For example, the supporting member may be formed integrally with the casing, the orbiting scroll, the fixed scroll, and so forth, to which the supporting member will be attached. Such a constitution can be similarly applied to other embodiments.

Further, in the first embodiment, the rotation prevention mechanisms 16 are independently disposed at three positions at an interval in the peripheral direction. However, the present invention is not limited to this. For example, the rotation prevention mechanisms (first and second ball coupling mechanisms) may be independently disposed at four or five positions at an interval in the peripheral direction. Such a constitution can be similarly applied to other embodiments.

Further, in the first embodiment, the rotation prevention mechanisms 16 (the first and second ball coupling mechanisms 17 and 23) are provided between the casing 4 and the orbiting scroll 8. However, when the thrust load acts toward the direction in which the orbiting scroll and the fixed scroll approach to each other, the rotation prevention mechanism may be provided between the orbiting scroll and the fixed scroll as the casing side. Such a constitution can be similarly applied to other embodiments.

Further, in each of the above embodiments, the scroll type air compressor has been described. However, this invention is not limited to them, and can be widely applied as a scroll type fluid machine for use in a vacuum pump, a refrigerant compressor, and the like.

What is claimed is:

1. A scroll fluid machine comprising:

a casing;

a fixed scroll provided in the casing and having a spiral wrap portion provided upright on an end plate;

an orbiting scroll having a wrap portion provided upright on an end plate and performing an orbiting motion in such a state that the wrap portion is overlapped with the wrap portion of the fixed scroll, thereby to compress or expand a fluid in a fluid chamber between these wrap portions; and a rotation prevention mechanism provided between the orbiting scroll and the casing side and preventing the rotation of the orbiting scroll, wherein the rotation prevention mechanism is constituted of:

a first ball coupling mechanism, which includes a pair of load supporting members provided so that ball support surfaces are opposed to each other between the orbiting scroll and the casing side, and a load supporting ball provided between the pair of load supporting members and supporting a load in a thrust direction, the ball support surfaces of the load supporting members comprising an annular-shaped groove formed to have a circular arc-shaped cross section, and a second ball coupling mechanism, which includes a pair of rotation prevention supporting members provided so that ball support surfaces are opposed to each other between the orbiting scroll and the casing side and a rotation prevention ball provided between the pair of rotation prevention supporting members and preventing the rotation of the orbiting scroll, the ball support surfaces of the rotation prevention supporting members comprising an annular-shaped peripheral wall protruding in an axial direction.

2. A scroll fluid machine according to claim 1, wherein when the load in the thrust direction acts on the orbiting scroll, the first ball coupling mechanism receives a larger load than the second ball coupling mechanism.

3. A scroll fluid machine according to claim 1, wherein when a rotation force acts on the orbiting scroll, the second ball coupling mechanism receives a larger rotation force than the first ball coupling mechanism.

4. A scroll fluid machine according to claim 1, wherein the both end sides in the thrust direction of the load supporting ball of the first ball coupling mechanism make a rolling-contact with the pair of load supporting members, and the both end sides in a direction inclined from the thrust direction of the rotation prevention ball of the second ball coupling mechanism make a rolling-contact with the pair of the rotation prevention supporting members.

5. A scroll fluid machine according to claim 1, wherein the load supporting ball of the first ball coupling mechanism has a larger diameter than that of the rotation prevention ball of the second ball coupling mechanism.

6. A scroll fluid machine according to claim 1, wherein the first and second ball coupling mechanisms are disposed at a position separated from each other in the radial direction of the orbiting scroll.

7. A scroll fluid machine according to claim 1, wherein the load supporting member of the first ball coupling mechanism and the rotation prevention supporting member of the second ball coupling mechanism are integrally formed.

8. A scroll fluid machine according to claim 1, wherein the first ball coupling mechanism is disposed between the orbiting scroll and the casing, and the second ball coupling mechanism is disposed between the orbiting scroll and the fixed scroll.

9. A scroll fluid machine comprising:

a casing;

a fixed scroll provided in the casing and having a spiral wrap portion provided upright on an end plate;

an orbiting scroll having a wrap portion provided upright on an end plate and performing an orbiting motion in such a state that the wrap portion is overlapped with the wrap portion of the fixed scroll, thereby to compress or expand a fluid in a fluid chamber between these wrap portions; and a rotation prevention mechanism provided between the orbiting scroll and the casing side and preventing the rotation of the orbiting scroll, wherein the rotation prevention mechanism is constituted of:

a first ball coupling mechanism, which includes a pair of load supporting members provided so that ball support surfaces are opposed to each other between the orbiting scroll and the casing side and a load supporting ball provided between the pair of load supporting members and supporting a load in a thrust direction, the ball support surfaces of the load supporting members comprising an annular-shaped groove formed to have a circular arc-shaped cross section, and a second ball coupling mechanism, which includes a pair of rotation prevention supporting members provided so that ball support surfaces are opposed to each other between the orbiting scroll and the casing side and a rotation prevention ball provided between the pair of rotation prevention supporting members and preventing the rotation of the orbiting scroll, the ball support surfaces of the rotation prevention supporting members comprising an annular-shaped peripheral wall protruding in an axial direction, wherein at least three pairs of the rotation prevention mechanisms constituted of a pair of the first and second ball coupling mechanisms are disposed at an interval in a peripheral direction so as to be located on the outer peripheral side of the orbiting scroll.

10. A scroll fluid machine according to claim 9, wherein when the load in the thrust direction acts on the orbiting scroll, the first ball coupling mechanism receives a larger load than the second ball coupling mechanism.

11. A scroll fluid machine according to claim 9, wherein when a rotation force acts on the orbiting scroll, the second ball coupling mechanism receives a larger rotation force than the first ball coupling mechanism.

12. A scroll fluid machine according to claim 9, wherein the both end sides in the thrust direction of the load supporting ball of the first ball coupling mechanism make a rolling-contact with the pair of load supporting members, and the both end sides in a direction inclined from the thrust direction of the rotation prevention ball of the second ball coupling mechanism make a rolling-contact with the pair of the rotation prevention supporting members.

13. A scroll fluid machine according to claim 9, wherein the load supporting ball of the first ball coupling mechanism has a larger diameter than that of the rotation prevention ball of the second ball coupling mechanism.

14. A scroll fluid machine according to claim 9, wherein the load supporting member of the first ball coupling mechanism and the rotation prevention supporting member of the second ball coupling mechanism are integrally formed.

15. A scroll fluid machine according to claim 9, wherein the first ball coupling mechanism is disposed between the orbiting scroll and the casing, and the second ball coupling mechanism is disposed between the orbiting scroll and the fixed scroll.

16. A scroll fluid machine comprising:

a casing;

a fixed scroll provided in the casing and having a spiral wrap portion provided upright on an end plate;

an orbiting scroll having a wrap portion provided upright on an end plate and turning in such a state that the wrap portion is overlapped with the wrap portion of the fixed scroll, thereby to compress or expand a fluid in a fluid chamber between these wrap portions; and a rotation prevention mechanism provided between the orbiting scroll and the casing side and preventing the rotation of the orbiting scroll, wherein the rotation prevention mechanism is constituted of:

a first ball coupling mechanism, which is constituted of a pair of load supporting members provided so that ball support surfaces are opposed to each other between the orbiting scroll and the casing side, and a load supporting ball provided between the pair of load supporting members and supporting a load in a thrust direction, the ball support surfaces of the load supporting members comprising an annular-shaped groove formed to have a circular arc-shaped cross section, and an annular-shaped groove provided in the ball support surfaces of the pair of load supporting members and having a circular arc-shaped cross section making a rolling-contact with the both end sides in the thrust direction of the load supporting ball, and a second ball coupling mechanism constituted of a pair of rotation prevention supporting members provided so that ball support surfaces are opposed to each other between the orbiting scroll and the casing side, a rotation prevention ball provided between the pair of rotation prevention supporting members and preventing the rotation of the orbiting scroll, the ball support surfaces of the rotation prevention supporting members comprising an annular-shaped peripheral wall protruding in an axial direction, and a circular groove provided in the ball support surfaces of the pair of rotation prevention supporting members and having a peripheral wall with a linear cross section making a rolling-contact with the both end sides in a direction inclined from the thrust direction of the rotation prevention ball.

17. A scroll fluid machine according to claim 16, wherein when the load in the thrust direction acts on the orbiting scroll, the first ball coupling mechanism receives a larger load than the second ball coupling mechanism.

18. A scroll fluid machine according to claim 16, wherein when a rotation force acts on the orbiting scroll, the second ball coupling mechanism receives a larger rotation force than the first ball coupling mechanism.

19. A scroll fluid machine according to claim 16, wherein the load supporting ball of the first ball coupling mechanism has a larger diameter than that of the rotation prevention ball of the second ball coupling mechanism.

20. A scroll fluid machine according to claim 16, wherein the load supporting member of the first ball coupling mechanism and the rotation prevention supporting member of the second ball coupling mechanism are integrally formed.

21. A scroll fluid machine according to claim 16, wherein the first ball coupling mechanism is disposed between the orbiting scroll and the casing, and the second ball coupling mechanism is disposed between the orbiting scroll and the fixed scroll.

* * * * *